US007577377B2

(12) United States Patent
Miyamoto et al.

(10) Patent No.: US 7,577,377 B2
(45) **Date of Patent: *Aug. 18, 2009**

(54) DEVELOPING DEVICE, PROCESS CARTRIDGE AND IMAGE FORMING APPARATUS INCLUDING THE SAME

(75) Inventors: Satoru Miyamoto, Kanagawa (JP); Makoto Yasuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 328 days.

This patent is subject to a terminal disclaimer.

(21) Appl. No.: 11/257,032

(22) Filed: Oct. 25, 2005

(65) Prior Publication Data

US 2006/0099009 A1 May 11, 2006

(30) Foreign Application Priority Data

Nov. 5, 2004 (JP) ..... 2004-322851

(51) Int. Cl.
*G03G 9/10* (2006.01)

(52) U.S. Cl. ..... 399/111; 399/111.1; 399/119; 430/111.3

(58) Field of Classification Search ..... 399/111, 399/111.1, 119; 430/111.3
See application file for complete search history.

(56) References Cited

U.S. PATENT DOCUMENTS

| | | | | |
|---|---|---|---|---|
| 5,380,616 | A | 1/1995 | Aoki et al. | |
| 5,840,456 | A | 11/1998 | Tomita et al. | |
| 5,919,592 | A | 7/1999 | Yaguchi et al. | |
| 5,975,446 | A | 11/1999 | Yaguchi et al. | |
| 5,998,074 | A | 12/1999 | Miyamoto et al. | |
| 6,355,389 | B1 | 3/2002 | Miyamoto | |
| 6,432,590 | B1 | 8/2002 | Ueda et al. | |
| 7,340,202 | B2 * | 3/2008 | Miyamoto et al. | 399/267 |
| 7,381,513 | B2 * | 6/2008 | Suzuki et al. | 430/111.35 |
| 2006/0067741 | A1 * | 3/2006 | Azami | 399/267 |
| 2006/0099009 | A1 | 5/2006 | Miyamoto et al. | |

FOREIGN PATENT DOCUMENTS

| | | |
|---|---|---|
| JP | 4-68376 | 3/1992 |
| JP | 6-338213 | 12/1994 |
| JP | 7-14430 | 1/1995 |
| JP | 9-179353 | 7/1997 |
| JP | 2000-89549 | 3/2000 |

(Continued)

OTHER PUBLICATIONS

Abstract of JP407225499A, Aug. 1995.*

(Continued)

*Primary Examiner*—Hoa V Le
(74) *Attorney, Agent, or Firm*—Oblon, Spivak, McClelland, Maier & Neustadt, P.C.

(57) ABSTRACT

In a developing device of the present invention, the ratio of the volume of a two-ingredient type developer to the capacity of a space storing the developer is selected to range from 40% to 75%. A carrier, forming part of the developer, is made up of a core and a resinous coating layer formed on the core. The resinous coating layer contains conductive particles each having a tin dioxide layer formed on a core and an indium oxide layer formed on the tin dioxide layer and containing tin dioxide. The conductive particles are provided with an oil absorbing amount ranging from 10 ml/100 g to 300 ml/100 g.

9 Claims, 8 Drawing Sheets

FOREIGN PATENT DOCUMENTS

| | | |
|---|---|---|
| JP | 2000-242044 | 9/2000 |
| JP | 2001-343787 | 12/2001 |
| JP | 2003-255588 | 9/2003 |
| JP | 2004-252211 | 9/2004 |
| JP | 2005-24592 | 1/2005 |
| JP | 2005-24593 | 1/2005 |
| JP | 2004-170714 | 6/2007 |

OTHER PUBLICATIONS

U.S. Appl. No. 11/608,521, filed Dec. 8, 2006, Satoru et al.
U.S. Appl. No. 12/020,713, filed Jan. 28, 2008, Matsumoto, et al.
U.S. Appl. No. 09/384,797, filed Aug. 27, 1999, Satoru Miyamoto.
U.S. Appl. No. 11/853,490, filed Sep. 11, 2007, Miyamoto et al.

* cited by examiner

DEVELOPING DEVICE, PROCESS CARTRIDGE AND IMAGE FORMING APPARATUS INCLUDING THE SAME

BACKGROUND OF THE INVENTION

1. Field of the Invention

The present invention relates to a copier, printer, facsimile apparatus, multifunction machine or similar electrophotographic image forming apparatus. More particularly, the present invention relates to a developing device using a two-ingredient type developer made up of toner particles and carrier particles, a process cartridge and an image forming apparatus including the same.

2. Description of the Background Art

It is a common practice with a color copier, color printer or similar image forming apparatus to execute development with a two-ingredient type developer consisting of toner particles and carrier particles, as taught in, e.g., Japanese patent laid-open publication No. 2004-212560. The developer of the type mentioned may or may not contain additives coating the surfaces of the particles. It is generally accepted that a developing system using the two-ingredient type developer is advantageous over a developing system using a single-ingredient type developer, i.e., toner in that it makes the chargeability of toner stable for thereby implementing stable, high quality images.

Japanese patent laid-open publication No. 2004-212560 mentioned above, for example, pertains to an image forming apparatus of the type including a developing system using a two-ingredient type developer, which contains a carrier having a small particle diameter, and using only a DC bias for development. The image forming apparatus is configured to reduce carrier deposition and control granularity, local omission around characters and other defects of images. For this purpose, the static resistance and saturation magnetization of the carrier are optimized when use is made of carrier particles having a diameter as small as 20 μm to 60 μm.

Japanese patent laid-open publication No. 7-140723, for example, proposes to use a carrier containing carbon black as a resistance control agent for the purpose of obviating carrier deposition and other defects and stabilizing the amount of charge against aging.

A problem with conventional technologies is that cumulative time consumed to agitate a developer increases due to repeated development or aging, making it impractical to surely obviate granular images. This is particularly true when use is made of a two-ingredient type developer in which a carrier contains carbon black as a resistance control agent.

In the image forming apparatus disclosed in laid-open publication No. 2004-212560 mentioned previously, particular conditions, including static resistance and saturation magnetization, are assigned to the carrier having a small particle diameter in order to reduce carrier deposition as well as granular images and local omission around characters. However, the developer stored in a developing device is subject to stress ascribable to, e.g., agitation over a long time due to repeated development, so that toner also contained in the developer is damaged and lowers the fluidity of the entire developer. Consequently, it is likely that a granular image, controlled as expected in the initial stage, is produced due to aging. Granularity is particularly conspicuous when the carrier has a small particle diameter or when the amount of the developer is increased.

Laid-open publication No. 7-140723 also mentioned previously is expected to obviate carrier deposition and stabilize the amount of charge with carbon black contained in the carrier as a resistance control agent. However, it is likely that carbon black contained in the carrier is transferred to toner due to aging causes the toner to cohere, lowering the fluidity of the entire developer and therefore causing granularity to appear in images.

Technologies relating to the present invention are also disclosed in, e.g., Japanese patent laid-open publication No. 2000-089549.

SUMMARY OF THE INVENTION

It is an object of the present invention to provide a developing device capable of surely controlling the granularity of images ascribable to aging, a process cartridge and an image forming apparatus using the same.

A developing device of the present invention stores a two-ingredient type developer made up of toner particles and carrier particles for developing a latent image formed on an image carrier. The ratio of the volume of the developer to the capacity of a space storing the developer is selected to range from 40% to 75%. The carrier particles each are made up of a core and a resinous coating layer formed on the core. The resinous coating layer contains conductive particles each comprising a tin dioxide layer formed on a core and an indium oxide layer formed on said tin dioxide layer and containing tin dioxide.

A process cartridge and an image forming apparatus including the above developing device are also disclosed.

BRIEF DESCRIPTION OF THE DRAWINGS

The above and other objects, features and advantages of the present invention will become more apparent from the following detailed description taken with the accompanying drawings in which.

In the figures, identical structural elements are designated by identical reference numerals.

DESCRIPTION OF THE PREFERRED EMBODIMENT

We conducted a series of experiments to solve the problems stated earlier and found the following. By using a carbonless carrier, i.e., a carrier not containing carbon black and provided with a conductive coating layer made up of a tin dioxide layer and an indium oxide layer, it is possible to prevent the fluidity of a developer from decreasing without lowering, e.g., reproducibility, thereby reducing granular images ascribable to aging. However, the carbonless carrier is not enough alone, but must be accompanied by the reduction of stress to act on a two-ingredient type developer stored in a developing device. A conspicuous correlation exists between stress to act on the two-ingredient type developer and the ratio of the volume occupied by the developer to the capacity of a space available in the developing device for storing the developer, i.e., a spatial volume ratio in the developing device.

A preferred embodiment of the present invention will be described hereinafter. It is to be noted that a process cartridge to appear in the following description is assumed to be a unit removably mounted to the body of an image forming apparatus and including an image carrier and at least one of a charger for uniformly charging the surface of the image carrier, a developing device for developing a latent image formed on the image carrier and a cleaning device for cleaning the image carrier after image transfer.

Figure 1:
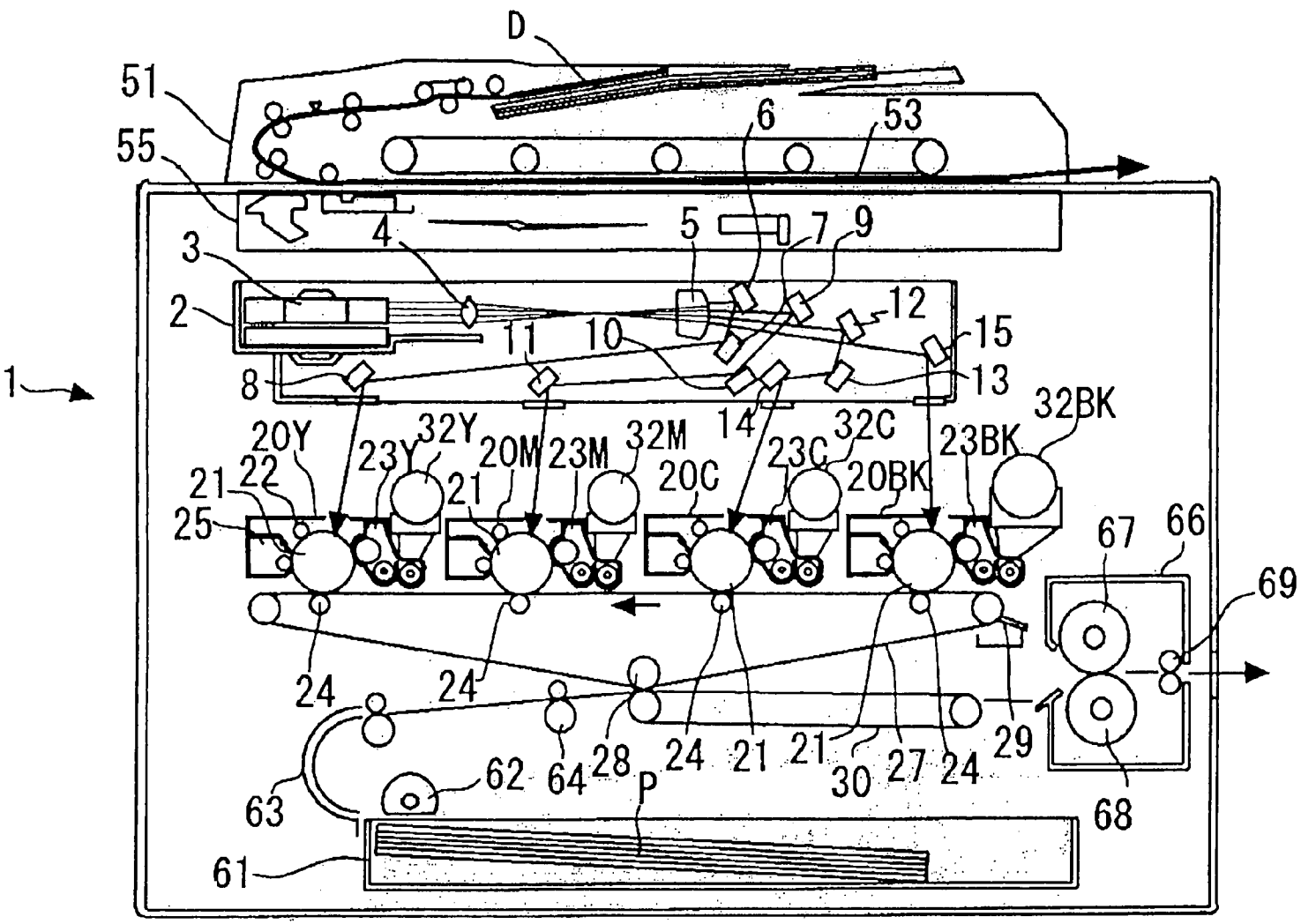
FIG. 1 is a view showing the general construction of an image forming apparatus embodying the present invention.

Referring to FIG. 1 of the drawings, an image forming apparatus embodying the present invention is shown and implemented as a color copier by way of example. As shown, the color copier includes a copier body or apparatus body 1. An optical writing section or exposing section 2 emits laser beams each being modulated in accordance with particular image data. Process cartridges 20Y, 20M, 20C and 20BK are assigned to Y (yellow), M (magenta), C (cyan) and BK (black), respectively. A photoconductive drum, which is a specific form of an image carrier, 21 is included in each of the process cartridges 20Y through 20BK. A charger 22 uniformly charges the surface of the photoconductive drum (simply drum hereinafter) 21 associated therewith. Developing devices 23Y, 23M, 23C and 23BK each are constructed to develop a latent image electrostatically formed on the drum 21 associated therewith. Bias rollers for image transfer 24 each develop the latent image formed on the drum 21 associated therewith. Cleaning devices 25 each collect toner left on the drum 21 associated therewith after image transfer.

A plurality of toner images of different colors are sequentially transferred from the drums 21 to an intermediate image transfer belt 27 one above the other, as will be described more specifically later. A second bias roller for image transfer 28 transfers a full-color toner image formed on the intermediate image transfer belt (simply belt hereinafter) 27 to a paper sheet or similar recording medium P. A belt cleaner or cleaning section 29 collects toner left on the belt 27 after image transfer. A belt conveyor 30 conveys the paper sheet P carrying the full-color toner image thereon.

Toner replenishing sections 32Y, 32M, 32C and 32BK replenish yellow toner, magenta toner, cyan toner and black toner to the developing devices 23Y, 23M, 23C and 23BK, respectively. An ADF (Automatic Document Feeder) or document conveying section 51 is configured to convey a stack of documents D to a scanner or document reading section 55 one by one. The scanner 55 reads image information out of the document D brought thereto. A sheet or recording medium feeding section 61 is loaded with a stack of paper sheets P. A fixing unit 66 fixes the toner image carried on the paper sheet P.

In the illustrative embodiment, the process cartridges 20Y through 20BK each are made up of the drum 21, charger 22 and cleaning section 25 and removed from the copier body 1 at a preselected cycle for replacement. Likewise, the developing devices 23Y through 23BK each are removed from the copier body 1 at a preselected cycle for replacement. A yellow, a magenta, a cyan and a black toner image are formed on the drums 21 of the process cartridges 20Y, 20M, 20C and 20BK, respectively.

A usual, color image forming mode available with the illustrative embodiment will be described hereinafter. A document D is fed from a document tray included in the ADF 51 by rollers in a direction indicated by an arrow in FIG. 1 and then brought to a stop on a glass platen 53 included in the scanner 55. In this condition, the scanner 55 scans the document D in order to optically read image information out of the document D.

More specifically, a lamp or light source included in the ADF 55 illuminates the document D positioned on the glass platen 53 while being moved in a preselected direction. The resulting reflection from the document D is focused on a color image sensor via mirrors and a lens. The color sensor reads color image data out of the document D separated into an R (red), a G (green) and B (blue) component. The R, G and B component each are converted to a particular electric image signal. Subsequently, a signal processor, not shown, executes color conversion, color correction, spatial frequency correction and other conventional processing with the R, G and B image signals for thereby generating yellow, magenta, cyan and black color image data.

The yellow, magenta, cyan and black image data are sent to the optical writing section 2. In response, the optical writing section 2 emits laser beams or exposing light beams, which are modulated in accordance with the yellow, magenta, cyan and black image data, toward the drums 21 of the process cartridges 20Y, 20M, 20C and 20BK, respectively.

On the other hand, the drums 21 of the process cartridges 20Y through 20BK are rotated clockwise each, as viewed in FIG. 1. The surface of each drum 21 in rotation is first uniformly charged by the charger 22 associated therewith. This step will be referred to as a charging step hereinafter. The charging step deposits a preselected charge potential on the surface of the drum 21. Subsequently, the charged surface of the drum 21 is brought to a position where the laser beam of the associated color is to be incident.

The optical writing section 2 emits the laser beams each being modulated in accordance with the image signal of a particular color, as stated previously. The laser beams each are reflected by a polygonal mirror 3 and then transmitted through lenses 4 and 5. The laser beams thus passed through the lenses 4 and 5 each are propagated through a particular optical path assigned to yellow, magenta, cyan or black. This step will be referred to as an exposing step hereinafter.

The laser beam corresponding to the yellow component is sequentially reflected by mirrors 6, 7 and 8 and then incident on the surface of the drum 21 included in the process cartridge 20Y, which is located at the rightmost position in FIG. 1. This laser beam is caused to scan the surface of the drum 21, which has been charged by the charger 22, in the main scanning direction, i.e., the axial direction of the drum 21. As a result, a latent image corresponding to the yellow component is electrostatically formed on the drum 21.

Likewise, the laser beam corresponding to the magenta component is sequentially reflected by mirrors 9, 10 and 11 and then incident on the charged surface of the drum 21 of the second process cartridge 20M from the left, as viewed in FIG. 1, forming a latent image corresponding to the magenta component. Also, the laser beam corresponding to the cyan component is sequentially reflected by mirrors 12, 13 and 14 and then incident on the charged surface of the drum 21 of the third process cartridge 20C from the left, as viewed in FIG. 1, forming a cyan image corresponding to the cyan component. Further, the laser beam corresponding to the black component is reflected by a mirrors 15 and then incident on the charged surface of the drum 21 of the fourth process cartridge 20BK from the left, as viewed in FIG. 1, forming a black image corresponding to the black component.

Subsequently, the surfaces of the drums 21, each carrying one of the latent images of the different colors, are brought to positions where they respectively face the developing units 23Y through 23BK. The developing units 23Y through 23BK deposit toner of respective colors on the latent images formed on the drums 21 for thereby forming corresponding toner images. This step will be referred to as a developing step hereinafter.

Figure 2:
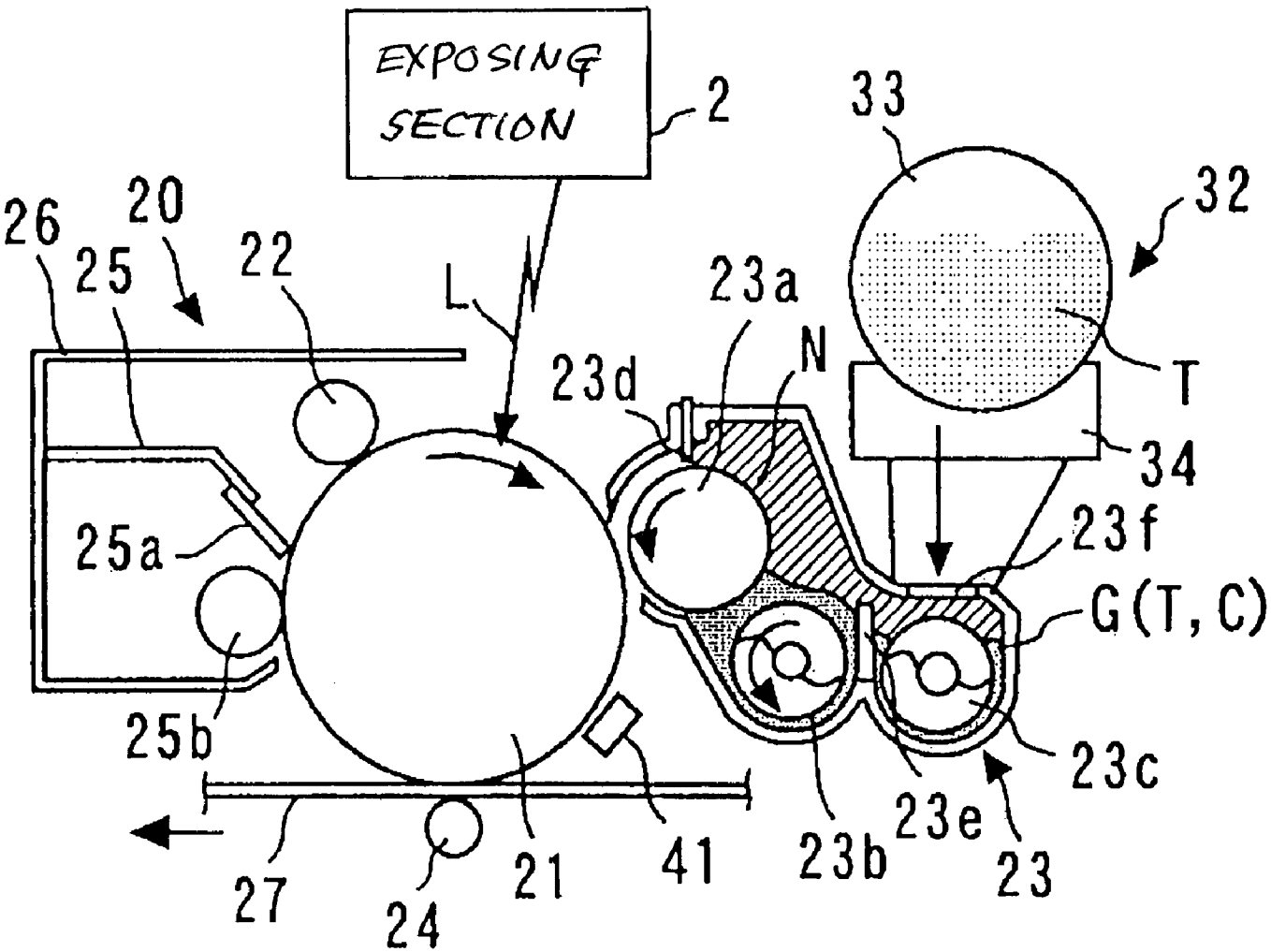
FIG. 2 is a section showing one of four image forming sections included in the illustrative embodiment.

The surface of each drum 21, carrying the toner image thereon, is then brought to, via a photosensor 41 shown in FIG. 2, a position where it faces the belt 27. At this position, the bias roller for image transfer 24, held in contact with the inner surface of the belt 27, transfers the toner image from the drum 21 to the belt 27. Such image transfer is repeated to sequentially transfer the toner images of different colors from the drums 21 to the belt 27 one above the other, completing a full-color or four-color toner image on the belt 27. This step will be referred to as a first or primary image transferring step hereinafter.

The surface of each drum 21 undergone the first image transferring step is brought to a position where it faces the cleaning section 25. The cleaning section 25 collects toner left on the drum 21 after the first image transferring step. This step will be referred to as a cleaning step hereinafter. Thereafter, the surface of the drum 21 thus cleaned is moved via a discharging section, not shown, completing a sequence of image forming steps.

On the other hand, the surface of the belt 27, carrying the full-color image thereon, is moved in a direction indicated by an arrow in FIG. 1 to the second bias roller for image transfer 28. The second bias roller 28 transfers the full-color image from the belt 27 to the paper sheet 8. This step will be referred to as a second or secondary image transferring step hereinafter. Subsequently, when the surface of the belt 27 is brought to the belt cleaner 29, the belt cleaner 29 collects toner left on the belt 27 after the second image transferring step, completing a sequence of image transferring steps.

The paper sheet P is conveyed from the sheet feeding section 61 to the second bias roller 28 via a guide 63, a registration roller pair 64 and so forth. More specifically, the paper sheet P is paid out from the sheet feeding section 61 by a pickup roller 62 and then conveyed to the registration roller pair 64 via the guide 63. The registration roller pair 64 once stops the paper sheet P to correct its skew and again conveys the paper sheet P toward the second bias roller 28 at preselected timing synchronous to the movement of the full-color toner image carried on the belt 27.

The paper sheet P, carrying the full-color toner image thereon, is conveyed to the fixing unit 66 by the belt conveyor 30. The fixing unit 66 fixes the full-color image on the paper sheet P at a nip between a heat roller 67 and a press roller 68. Finally, the paper sheet or copy P, coming out of the fixing unit 66, is driven out of the copier body 1. This is the end of the image forming process of the illustrative embodiment.

Figure 3:
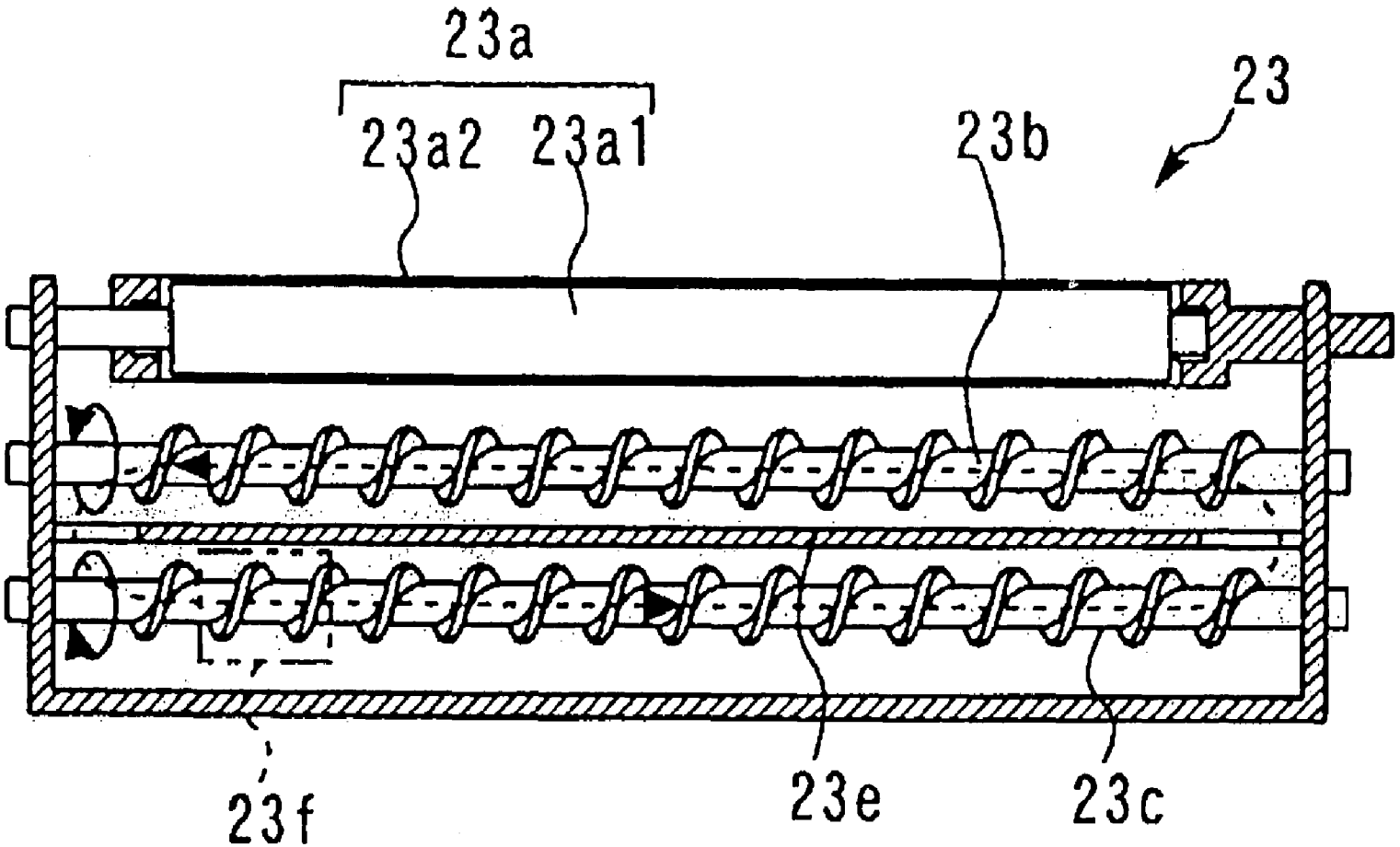
FIG. 3 is a section showing a developing device included in the image forming section of FIG. 2.

Reference will be made to FIGS. 2 and 3 for describing the configuration of each image forming section included in the illustrative embodiment. FIG. 2 is a section showing one of the four image forming sections while FIG. 3 is a section of the developing device of the image forming section taken in the lengthwise direction, i.e., the direction perpendicular to the sheet surface of FIG. 2. Because the four image forming sections are substantially identical in configuration except for the color of toner used for development, the suffixes Y, M, C and BK attached to the reference numerals designating the process cartridges, developing devices and toner replenishing sections will be omitted.

As shown in FIG. 2, the process cartridge 20 includes a casing 26 mainly accommodating the drum or image carrier 21, charger 22 and cleaning section 25. The cleaning section 25 includes a cleaning blade 25*a* and a cleaning roller 25*b* both contacting the drum 21.

The developing device 23 is generally made up of a developing roller 23*a* facing the drum 21, a first screw 23*b* facing the developing roller 23*a*, a second screw 23*c* facing the first screw 23*b* with the intermediary of a partition member 23*e*, and a doctor blade 23*d* facing the developing roller 23*e*. As shown in FIG. 3, the developing roller 23*a* includes a sleeve 23*a*2 rotatable relative to a magnet roller 23*a*1. The magnet roller 23*a*1 is held stationary inside the sleeve 23*a*2 and forms magnetic poles on the circumferential surface of the sleeve 23*a*2. The sleeve 23*a*2 has an outside diameter of 25 mm and a width or axial length of 328 mm. Grooves, having a generally V-shaped cross-section each, are formed in the sleeve 23*a*2 in the circumferential direction at a preselected pitch.

The magnet 23*a*1 forms seven magnetic poles on the circumference of the developing roller 23*a*. Among the seven magnetic poles, a main pole formed in a developing zone is configured such that the main-pole angle is 3 degrees, that the peak magnetic force is 120 mT and that the half-value width is 23 degrees. Also, a magnetic pole for scooping up a two-ingredient type developer G onto the developing roller 23*a* is configured such that the developer G is scooped up in an amount of 35±7.5 mg/cm$^2$.

The developing roller 23*a* and drum 21 are spaced from each other by a gap or development gap of 0.3±0.05 mm in the developing zone. Also, the developing roller 23*a* and doctor blade 23*d* are spaced from each other by a gap or doctor gap of 0.3±0.04 mm. The doctor blade 23*d* is formed of a magnetic material and positioned above a magnetic pole, or pole P6, formed on the developing roller 23*a* and having a peak magnetic force of 60 mT. The first and second screws 23*b* and 23*c* each are implemented by a screw having an outside diameter of 18 mm and formed on a core with a pitch of 25 mm. The core has a diameter of 8 mm.

In the illustrative embodiment, the developer G stored in the developing device 23 is configured to have a spatial volume ratio of 40% to 75%. This range of spatial volume ratio successfully reduces stress to act on the developer G due to the first and second screws 23*b* and 23*c* during agitation and stress to act thereon at the position of the doctor blade 23*d*, as will be described more specifically later. It is to be noted that the spatial volume ratio refers to the volume of the two-ingredient type developer G to the capacity of a space N in which the developer G is stored, as stated earlier.

Carrier particles C, forming part of the developer G, each are constituted by a core and a resinous coating layer covering the surface of the core. The resinous coating layer contains conductive particles each comprising a core and a conductive coating layer made up of a tin dioxide layer formed on the core and an indium oxide layer formed on the tin dioxide layer and containing tin dioxide. The conductive particles contained in the resinous coating layer have an oil absorbing amount ranging from 10 ml/100 g to 300 ml/100 g. The oil absorbing amount of conductive particles is measured in accordance with "21 Oil Absorbing Amount" prescribed in JIS (Japanese Industrial Standards) K5101 "Pigment Testing Method".

The cores of the conductive particles may be formed of at least one of aluminum oxide, titanium dioxide, zinc oxide, silicon dioxide, barium sulfide and zirconium oxide. The conductive particles have a specific powder resistance controlled to 200 Ω·cm or below. The resinous coating layer contains nonconductive particles in addition to the conductive particles. The carrier particles C have a specific volume resistance ranging from 10 Log(Ω·cm) to 16 Log(Ω·cm).

As stated above, in the illustrative embodiment, the carrier particles C each are constituted by a core, a tin dioxide layer formed on the core, and an indium oxide layer formed on the tin dioxide layer and containing tin dioxide, so that a conductive layer is uniformly, firmly affixed to the surface of the particle.

The oil absorbing amount of the conductive particles, contained in the resinous coating layer, is controlled to 10 ml/100 g to 300 ml/100 g, as also stated above. If the oil absorbing amount is less than 10 ml/100 g, then the compatibility of the conductive particles with the coating layer is lowered with the result that adhesion and dispersion are lowered. This makes it impossible to control the resistance of the carrier particles over a long time. On the other hand, if the oil absorbing amount is greater than 300 ml/100 g, then the conductive particles excessively strongly adhere to binder resin and cover the surfaces of the conductive particles, obstructing resistance control.

The carrier C unique to the illustrative embodiment has its resistance controlled without resorting carbon black otherwise contained as a resistance control agent. This is successful to obviate carrier deposition and other troubles and stabilize the amount of charge over a long time.

Further, in the illustrative embodiment, the weight-mean particle diameter of the carrier C should preferably be controlled to 20 μm to 65 μm, more preferably to 35 μm. If the weight-mean particle diameter of the carrier C is less than 20 μm, then the magnetic force to act on each carrier particle decreases and therefore brings about carrier deposition. On the other hand, if the weight-mean particle diameter is greater than 65 μm, then toner fails to faithfully deposit on a latent image to thereby aggravate the granularity of images.

Toner T, forming the other part of the two-ingredient type developer G, has a mean particle size preferably controlled to 3.5 μm to 7.5 μm, more preferably to 6.8 μm. If the mean particle diameter of the toner T is less than 3.5 μm, then the amount of toner to deposit on a latent image decreases and is therefore apt to bring about the omission of the trailing edge of an image and a hollow image. If the mean particle diameter is greater than 7.5 μm, then toner fails to faithfully deposit on a latent image to thereby aggravate the granularity of images.

In the illustrative embodiment, the toner T mainly consists of binder resin, a parting agent and a colorant. The binder resin contains hybrid resin made up of a vinyl polymer and a polyester polymer. The ratio of the content of such hybrid resin to the content of the parting agent lies in the range of 0.5 to 3. To produce hybrid resin, a mixture of the ingredient monomer of condensation polymerization resin and the ingredient monomer of addition polymerization is subjected to condensation polymerization and addition polymerization, which are effected simultaneously or separately, in a single reaction bath. The parting agent may be implemented by, e.g., carnauba wax, montan wax or oxidized rice wax and has a content preferably controlled to 3.5 wt % to 10 wt %.

The toner T with the above configuration provides images with high durability, high quality free from irregular gloss and brings about a minimum of cohesion, fixation offset and other defects.

The image forming process stated previously, mainly the developing step included therein, will be described in more detail. The developing roller 23*a* is rotated in a direction indicated by an arrow in FIG. 2 at a speed of 430.9 rpm (revolutions per minute) at a linear velocity ratio to the drum 2 of 2. As shown in FIG. 3, the first and second screws 23*b* and 23*c* are rotated at a speed of 521.6 rpm in opposite directions to each other, as indicated by arrows, while being separated from each other by the partition member 23*e*. The two screws 23*b* and 23*c* cooperate to circulate, in the axial direction thereof, the developer present in the developing device 23 together with fresh toner T replenished from the toner replenishing section 32 via an inlet 23*f*, as indicated by a dashed arrow in FIG. 3. The toner T thus electrified by friction is deposited on the carrier C and then deposited on the developing roller 23*a* together with the carrier C.

The toner T and carrier C, i.e., developer G deposited on the developing roller 23*a* is brought to the doctor blade 23*d* and metered thereby. The developer G, thus controlled in thickness or amount by the doctor blade 23*d*, is conveyed to a position where it faces the drum 21. Subsequently, in the developing zone, the toner T of the developer G is transferred to a latent image formed on the drum 21. More specifically, the toner T is caused to deposit on the latent image by an electric field formed by a difference between the potential of an image portion scanned by a laser beam L, i.e., an exposure potential and a bias for development applied to the developing roller 23*a*. Let the above potential difference be referred to as a developing potential hereinafter.

The toner T deposited on the drum 21 by the developing step is mostly transferred to the belt 27. Part of the toner T left on the drum 21 without being transferred is collected in the cleaning section 25 by the cleaning blade 25*a* and cleaning roller 25*b*.

In the illustrative embodiment, the bias applied to the developing roller 23*a* does not contain an AC component, i.e., it is implemented only by a DC component so as to simplify the configuration and control of a power supply connected to the developing roller 23*a*.

The toner replenishing section 32 included in the copier body 1 is made up of a replaceable toner bottle or similar toner container 33 and a toner hopper 34 configured to replenish fresh toner T from the toner bottle 33 to the developing device 23 while holding and rotating the toner bottle 33. The toner T stored in the toner bottle 33 is one of yellow toner, magenta toner, cyan toner and black toner. A spiral ridge, not shown, is formed in the inner surface of the toner bottle 33.

The toner T in the toner bottle 33 is suitably replenished to the developing device 23 via the inlet 23*f* in accordance with the consumption of toner T present in the developing device 23. In the illustrative embodiment, the consumption of toner T present in the developing device 23 is sensed either directly or indirectly by the photosensor 41 mentioned earlier and a magnetic sensor not shown. The photosensor 41, facing the drum 21, is implemented by a reflection type photosensor while the magnetic sensor is disposed in the developing device 23. The inlet 23*f* is positioned at one end of the second screw 23*c* in the axial direction, i.e., the right-and-left direction in FIG. 3 above the second screw 23*c*.

In the illustrative embodiment, the toner content of the developer G is controlled to lie in the range of from 5 wt % to 13 wt % in order to reduce stress to act on the developer G stored in the developing device 23, as will be described more specifically later. A toner content below 5 wt % would lower carrier resistance to thereby aggravate carrier deposition while a toner content above 13 wt % would reduce the amount of charge (Q/M value) to deposit on the toner T to thereby aggravate background contamination and toner scattering.

Reference will be made to FIGS. 4 through 8 for describing relations between various characteristic values including toner content, bulk density, volume of developer and static torque determined by experiments. The experiments were conducted with the image forming apparatus of the illustrative embodiment; the space N of the developing device 23 had a capacity of 384 $cm^3$. It is to be noted that solid lines S1 through S3 and dotted lines S4 through S5 each are representative of the result of a particular experiment and subjected to collinear approximation or curve approximation.

In FIGS. 4 through 8, a solid line S1 and dotted lines S4 through S5 are representative of the results of experiments conducted with a carrier C having a weight-mean particle diameter of 35 μm and toner T having a mean particle diameter of 6.8 μm. The solid line S2 is representative of the result of an experiment in which a carrier C with a weight-mean particle diameter of 55 μm and toner T with a mean particle diameter of 6.8 μm were used. Further, the solid line S3 is representative of the result of an experiment in which a carrier C with a weight-mean particle diameter of 35 μm and toner T with a mean particle diameter of 5.5 μm were used.

Further, as for the solid lines S1 through S3, the developer G initially had a weight of 380 g, i.e., initially contained 349.6 g of carrier and 30.4 g of toner. By contrast, as for the dotted line S4, the developer G initially had a weight of 500 g, i.e., initially contained 460 g of carrier and 40 g of toner. Also, as for the dotted line S5, the developer G initially had a weight of 250 g, i.e., initially contained 230 g of carrier and 20 g of toner.

Figure 4:
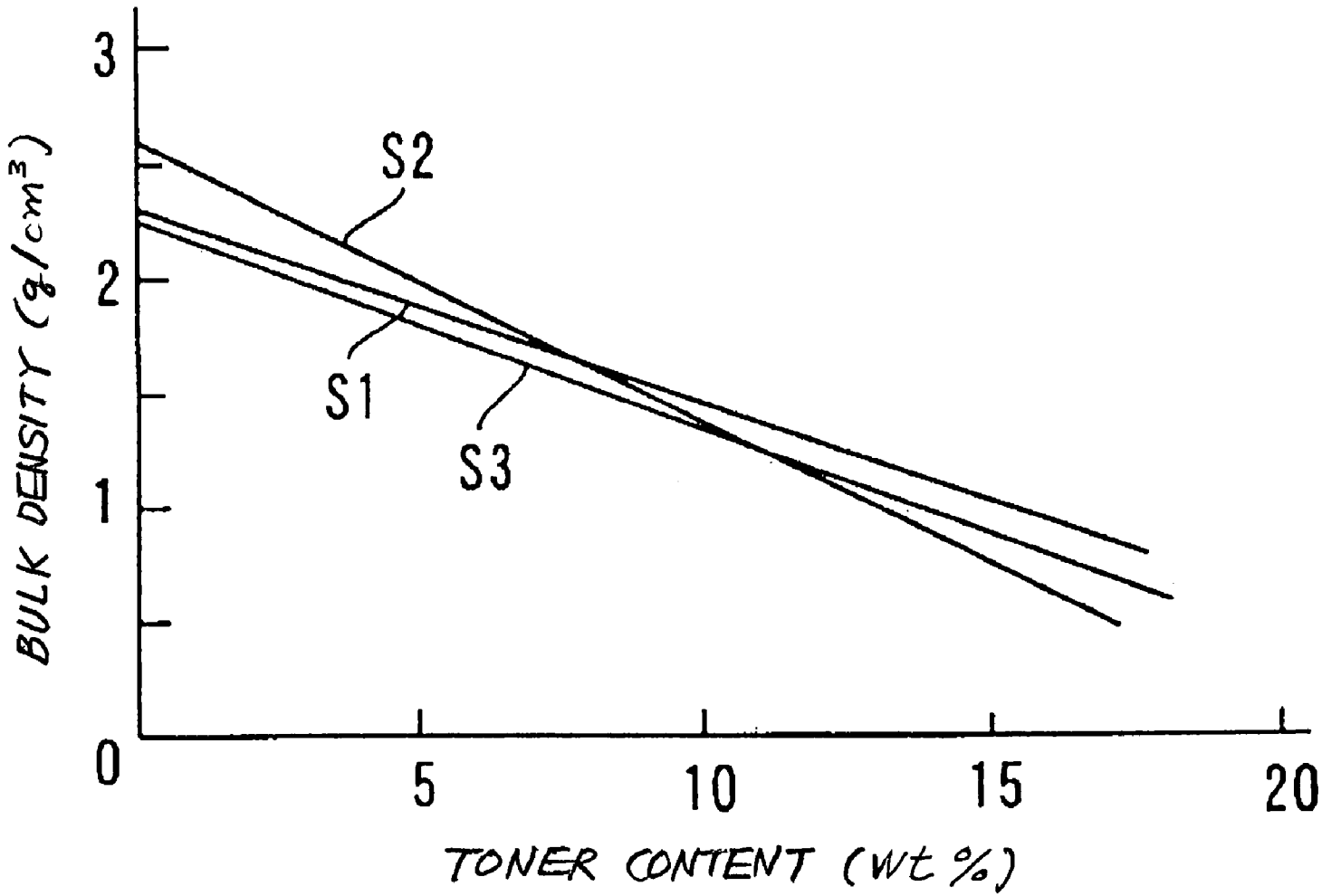
FIG. 4 is a graph showing a relation between a toner content and a bulk density.

More specifically, FIG. 4 shows a relation between the toner content and the bulk density of the developer G; the dotted lines S4 and S5 are not shown. As shown, when the toner content of the developer G increases, the amount of toner, occupying a preselected capacity increases while the amount of carrier decreases accordingly. As a result, the bulk density of the developer G decreases. The solid curves S1 through S3 are similar in slope to each other without regard to the particle size of carrier or that of toner.

Figure 5:
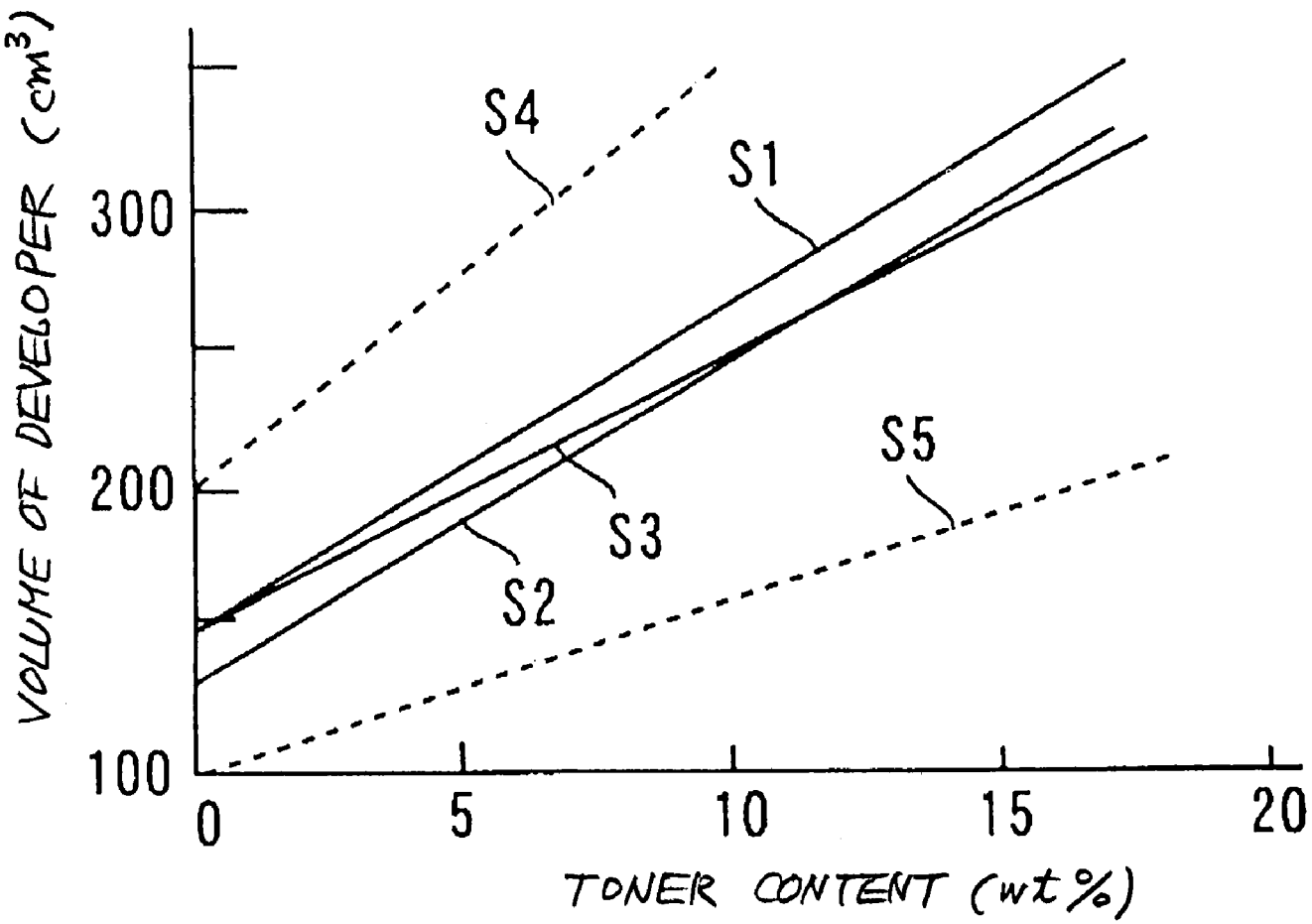
FIG. 5 is a graph showing a relation between the toner content and the volume of a developer.

FIG. 5 shows a relation between the toner content of the developer G and the volume of the developer G. As shown, when the toner content of the developer G increases, the volume of the developer G increases in accordance with the increase in the amount of toner. The solid lines S1 through S3 and dotted lines S4 and S5 are similar in slope to each other without regard to the particle size of carrier of that of toner or the amount of developer.

Figure 6:
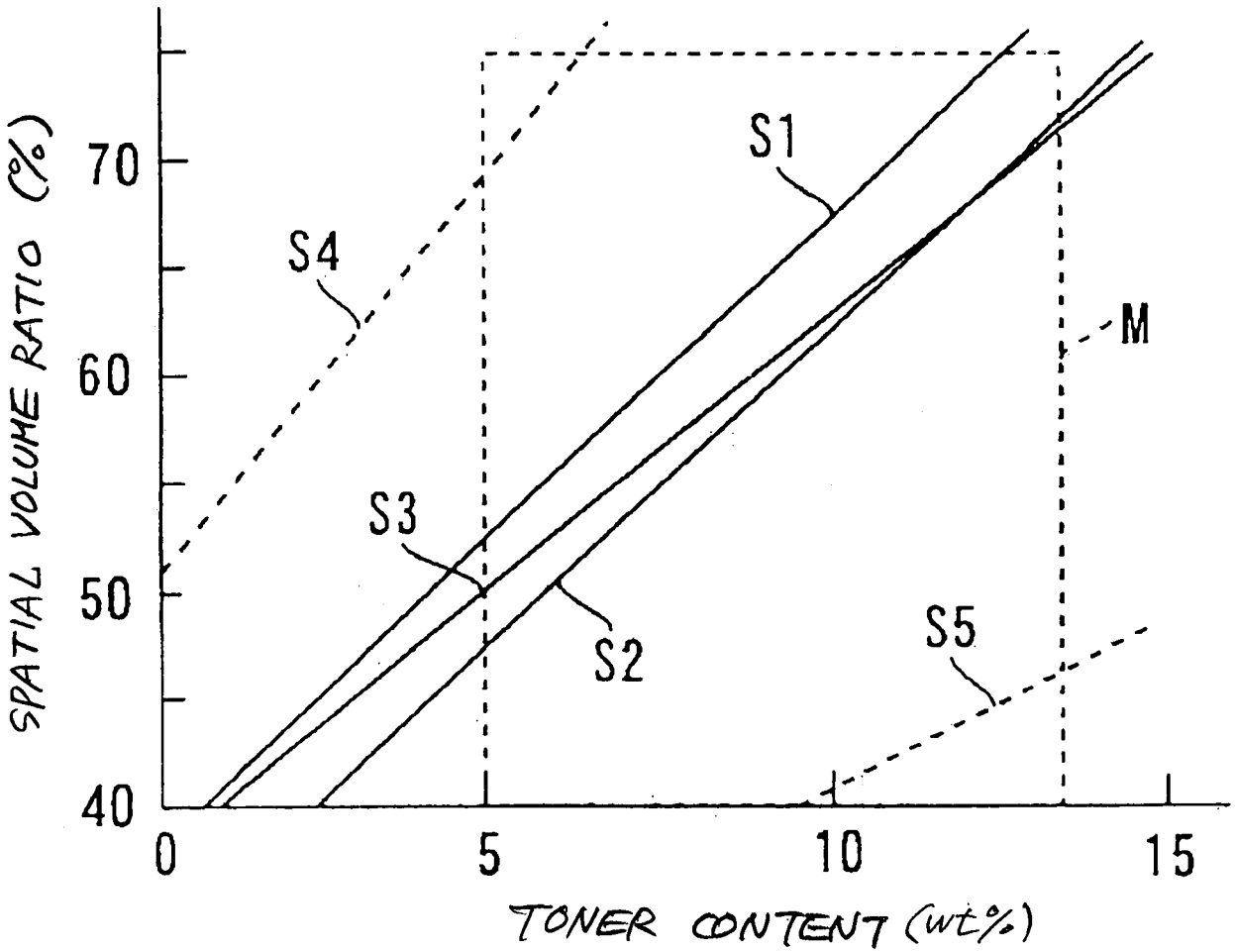
FIG. 6 is a graph showing a relation between the toner content and a spatial volume ratio.

FIG. 6 shows a relation between the toner content of the developer G and the spatial volume ratio of toner in the developing device 23. As shown, when the toner content of the developer G increases, the volume of the developer G and therefore the spatial volume ratio increases. The solid lines S1 through S3 and dotted lines S4 and S5 are similar in slope to each other without regard to the particle size of carrier of that of toner or the amount of developer.

Figure 7:
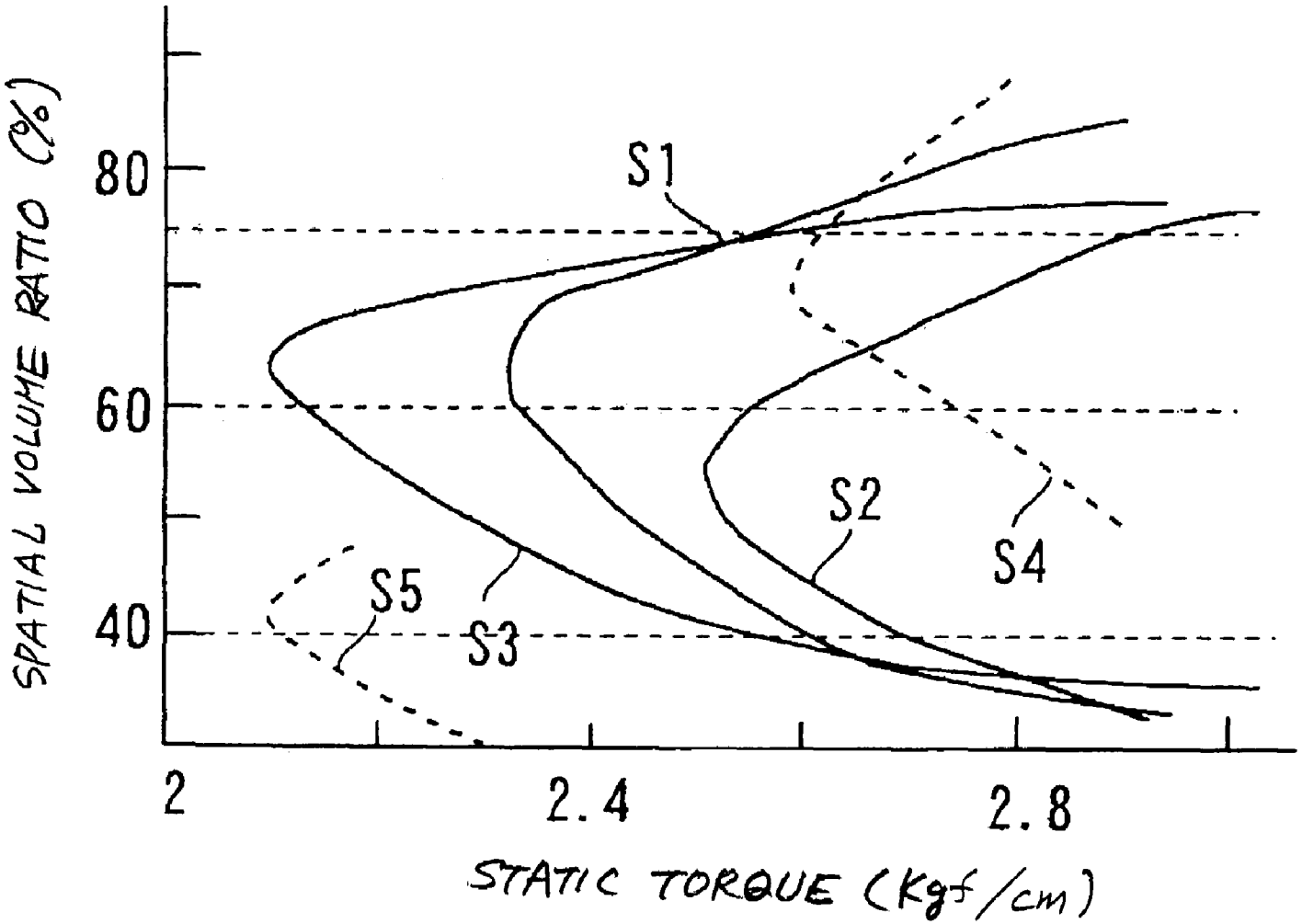
FIG. 7 is a graph showing a relation between a static torque and the spatial volume ratio.

FIG. 7 shows a relation between a static torque and a spatial volume ratio in the developing device 23. It is to be noted that the static torque was measured at a drive section assigned to the developing device 23 including the developing roller 23*a* and first and second screws 23*b* and 23*c*. As shown, when the spatial volume ratio lies in a preselected range, the static torque becomes minimum. However, when the spatial volume ratio does not lie in the preselected range, the static torque increases. The solid lines S1 through S3 and dotted lines S4 and S5 are similar in tendency to each other without regard to the particle size of carrier of that of toner or the amount of developer.

Figure 8:
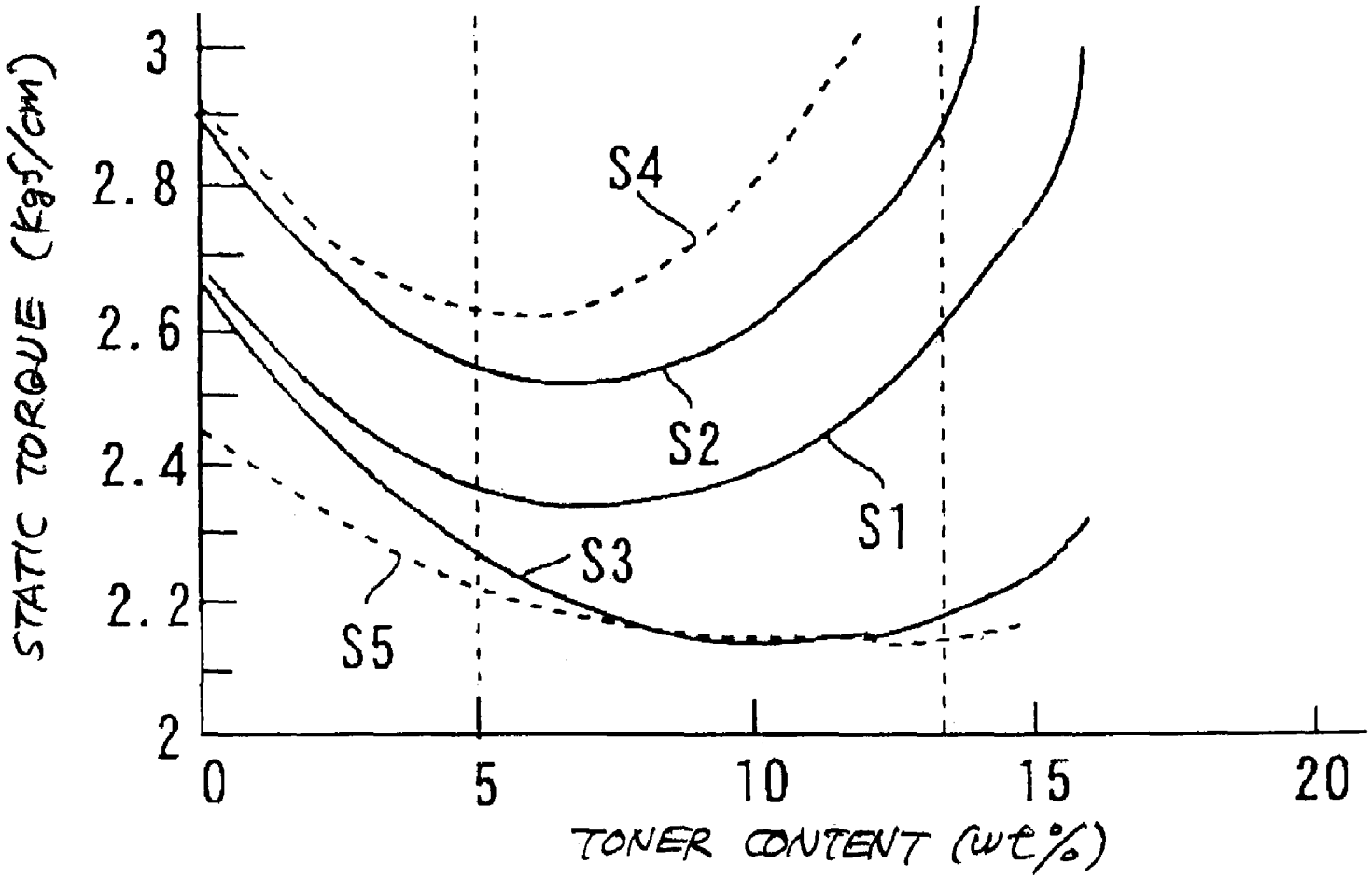
FIG. 8 is a graph showing a relation between the toner content and the static torque.

FIG. 8 shows a relation between the toner content of the developer G and the static torque in the developing device 23. As shown, the static torque is minimum if the toner content lies in a preselected range, but increases if otherwise. The solid lines S1 through S3 and dotted lines S4 and S5 are similar in tendency to each other without regard to the particle size of carrier of that of toner or the amount of developer.

The static torque is correlated to stress to act on the developer G, i.e., stress ascribable to agitation by the first and second screws 23*b* and 23*c* and stress ascribable to the doctor gap between the doctor blade 23*d* and the developing roller 23*a*. More specifically, when the static torque is great, the developer G is subject to heavy stress and comes to make images appear granular with the elapse of time. In the developing device 23 of the illustrative embodiment, static torque of 2.65 kgf/cm or below is optimum because it frees the developer G from the above stress and therefore substantially frees images from granularity.

As shown in FIG. 7, the static torque increases when the spatial volume ratio is excessively great or excessively small. When the spatial volume ratio is excessively great, the volume of the developer G increases, i.e., the developer G becomes densely packed with the result that loads, acting on the screws 23*b* and 23*c* and so forth, increase and cause the static torque to increase. When the spatial volume ratio is excessively small, the bulk density of the developer G increases and causes the loads on the screws 23*b* and 23*c* and so forth to increase, resulting in an increase in static torque.

As the solid lines S1 through S3 indicate, s long as the amount of the developer G is adequate, by confining the spatial volume ratio in the range of from 40% to 75%, preferably from 55% to 65%, it is possible to substantially reduce the static torque even if the particle size of carrier and/or that of the toner varies. Should the spatial volume ratio does not lie in the range of from 40% to 75%, the static torque and therefore stress to act on the developer G would noticeably increase. Stress acting on the developer G would accelerate toner spending to thereby aggravate the possibility of a granular image.

As the dotted line S4 indicates, when the amount of the developer G is excessively great, the static torque generally increases and causes heavier stress to act on the developer G. On the other hand, as the dotted line S5 indicates, when the amount of the developer G is excessively small, the life of the developer G is shortened although the static torque can be generally reduced. Further, because the amount of the developer G and spatial volume ratio are correlated to each other, i.e., the latter increases with an increase in the former, limiting the range of spatial volume rate results in limiting the amount of the developer G to a certain degree.

In the illustrative embodiment, the toner content of the developer G is controlled to the range of from 5 wt % to 13 wt % in order to control carrier deposition, background contamination and other defects. The solid curves S1 through S3 shown in FIG. 8 indicate that the static torque can be maintained relatively small if the toner content lies in the above particular range. A toner content, not lying in the range of from 5 wt % to 13 wt %, causes the static torque and therefore stress to act on the developer G to sharply increase.

Thus, in the illustrative embodiment, the spatial volume ratio and toner content lie in a range M delimited by a dotted line in FIG. 6. If such conditions are established, stress to act on the developer G in the developing device 23 is successfully reduced. It should be noted that a carbonless carrier, used as the carrier T in the illustrative embodiment, also contributes a great deal to the control of the granularity of an image ascribable to aging.

A running test, executed with the illustrative embodiment on the basis of the experimental results described above , showed that a granular image was noticeably reduced over a long time from the initial stage.

As stated above, in the illustrative embodiment, the spatial volume ratio in the developing device 23 is confined in a preselected range. Also, in the illustrative embodiment, the carrier C contains conductive particles each including a conductive coating layer made up of a tin dioxide layer and an indium oxide layer and having an oil absorbing amount confined in a preselected range. With these conditions, the illustrative embodiment can surely reduce granular images despite aging.

In the illustrative embodiment, the drum 21, charger 22 and cleaning section 25 are constructed into a single process cartridge 20Y, 20M, 20C or 20BK. In addition, the developing devices 23Y through 23BK are constructed into a single unit each. Alternatively, the developing devices 23Y through 23BK may be constructed integrally with the process cartridges 20Y through 20BK, respectively. More specifically, the process cartridges 20Y through 20BK each may be made up of the drum 21, charger 22, developing device 23 and cleaning section 25. Such an alternative configuration is capable of achieving the same advantages as the illustrative embodiment shown and described.

In summary, in accordance with the present invention, a spatial volume ratio in a developing device is confined in a preselected range. In addition, use is made of a containing conductive particles each including a conductive coating layer made up of a tin dioxide layer and an indium oxide layer and having an oil absorbing amount confined in a preselected range. With these conditions, the present invention realizes a developing device, a process cartridge and an image forming apparatus capable of surely reducing granular images despite aging.

Various modifications will become possible for those skilled in the art after receiving the teachings of the present disclosure without departing from the scope thereof.

What is claimed is:

1. In a developing device storing a two-ingredient type developer made up of a toner and a carrier for developing a latent image formed on an image carrier, the carrier comprises a core and a resinous coating layer formed on said core, and said resinous coating layer contains conductive particles each comprising a tin dioxide layer formed on a core and an indium oxide layer formed on said tin dioxide layer and containing tin dioxide.

2. In a developing device storing a two-ingredient type developer made up of a toner and a carrier for developing a latent image formed on an image carrier, a ratio of a volume of said two-ingredient type developer to a capacity of a space storing said two-ingredient type developer is selected to be between 40% and 75%, the carrier comprises a core and a resinous coating layer formed on said core, and said resinous coating layer contains conductive particles each comprising a tin dioxide layer formed on a core and an indium oxide layer formed on said tin dioxide layer and containing tin dioxide.

3. The developing device as claimed in claim 2, wherein a toner content of the developer is selected to be between 5 wt % and 14 wt %.

4. The developing device as claimed in claim 2, wherein a weight-mean particle diameter of the carrier is selected to be between 20 μm and 65 μm.

5. The developing device as claimed in claim 2, wherein a mean particle diameter of the toner is selected to be between 3.5 μm and 7.5 μm.

6. The developing device as claimed in claim 2, wherein the toner comprises a binder resin, a parting agent and a colorant, the binder resin comprises a hybrid resin consisting of a vinyl polymer and a polyester polymer, and a ratio of a content of the hybrid resin to a content of the parting agent is between 0.5 and 3.

7. In a process cartridge comprising a developing device and an image carrier constructed integrally with each other, said developing device stores a two-ingredient type developer made up of a toner and a carrier for developing a latent image formed on an image carrier, a ratio of a volume of the two-ingredient type developer to a capacity of a space storing said two-ingredient type developer is selected to be between 40% and 75%, the carrier comprises a core and a resinous coating layer formed on said core, said resinous coating layer contains conductive particles each comprising a tin dioxide layer formed on a core and an indium oxide layer formed on said tin dioxide layer and containing tin dioxide.

8. The developing device as claimed in claim 2, wherein the conductive particles have an oil absorbing amount ranging from 10 ml/100 g to 300 ml/100 g.

9. The process cartridge as claimed in claim 7, wherein the conductive particles have an oil absorbing amount ranging from 10 ml/100 g to 300 ml/100 g.

* * * * *